US012495880B1

(12) United States Patent
Lee et al.

(10) Patent No.: US 12,495,880 B1
(45) Date of Patent: Dec. 16, 2025

(54) ELEVATING MECHANISM FOR A STICK TYPE PRODUCT AND STICK TYPE CONTAINER HAVING THE SAME

(71) Applicant: SAMHWA CO., LTD, Uiwang-si (KR)

(72) Inventors: Kyungchang Lee, Uiwang-si (KR); Kwan Ho Lee, Suwon-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 0 days.

(21) Appl. No.: 18/823,331

(22) Filed: Sep. 3, 2024

(51) Int. Cl.
*A45D 40/06* (2006.01)
*A45D 40/04* (2006.01)
*A45D 40/00* (2006.01)

(52) U.S. Cl.
CPC ..... *A45D 40/06* (2013.01); *A45D 40/04* (2013.01); *A45D 40/065* (2013.01); *A45D 2040/0025* (2013.01)

(58) Field of Classification Search
CPC ..... A45D 40/04; A45D 40/06; A45D 40/065; A45D 2040/0025
USPC ..... 401/68, 75, 78
See application file for complete search history.

(56) References Cited

U.S. PATENT DOCUMENTS 7,357,588 B2 * 4/2008 Liard ..... A45D 40/04 401/74
7,500,799 B2 * 3/2009 Holloway ..... A45D 40/06 401/74
8,534,946 B2 * 9/2013 Cont ..... A45D 40/205 401/86

FOREIGN PATENT DOCUMENTS

KR 10-1760637 B1 7/2017

* cited by examiner

*Primary Examiner* — Jennifer C Chiang
(74) *Attorney, Agent, or Firm* — Bridgeway IP Law Group, PLLC; Jihun Kim

(57) ABSTRACT

An elevating mechanism for a stick type container is structured to allow simple assembly and therefore can be produced with lower manufacturing costs. The elevating mechanism may include: a holder member having a support part and a gear shaft, a connector member having a connector body, a bridge, and a securing ring; and a screw socket member. The screw socket member may be configured to have at least a portion inserted in the connector space, the screw socket member may have a hollow interior such that a screw space open at the top and bottom is formed on an inner side of the screw socket member, and the screw socket member may have an outwardly protruding detent protrusion formed on its upper portion.

9 Claims, 13 Drawing Sheets

ELEVATING MECHANISM FOR A STICK TYPE PRODUCT AND STICK TYPE CONTAINER HAVING THE SAME

BACKGROUND

1. Technical Field

The present invention relates to a container for a stick type product, more particularly to an elevating mechanism that allows convenient assembly and a stick type container that includes such elevating mechanism.

2. Description of the Related Art

A stick type product refers to a product in which a composition containing the needed ingredients is congealed in the form of a stick. A container for a stick type product is typically provided as a structure that keeps most of the stick material within the container while allowing the user to make a manipulation as necessary which exposes a portion of the stick to the outside. That is, as the stick type product is used and the exposed upper portion of the stick is expended, the upper portion of the stick may be worn away, and the stick may gradually be decreased in height. As a result, the stick type container would have to move the stick further upward if the stick is to maintain an exposed state. An example of this type of structure is disclosed in Korean Registered Patent No. 10-1760637. In addition to cosmetic products such as lipsticks and lip balms, various other products such as deodorants, glues, ointments, etc., are being provided in the form of stick type products.

A stick type product is generally manufactured in a considerably small size, since a stick type product is generally intended to be carried by the user, and since a product such as a lipstick and a lip balm in particular is manufactured in a size corresponding to the lips of a typical user. As a somewhat complicated structure for elevating and lowering the stick material must be implemented as a product having a small size, a high level of precision is required in manufacturing an elevating mechanism for a stick type product and a stick type container that includes the elevating mechanism.

SUMMARY OF THE INVENTION

An aspect of the present invention, which was conceived to resolve the problem described above, is to provide an elevating mechanism and a stick type container including the elevating mechanism that are structured to allow simple assembly and therefore can be produced with lower manufacturing costs.

Other objectives of the present invention will be more clearly understood from the embodiments set forth below.

One aspect of the invention provides an elevating mechanism for a stick type product. The elevating mechanism may include: a holder member having a support part and a gear shaft, where the support part may be configured to support a stick material on its upper portion and be movable along a vertical direction, and where the gear shaft may extend downward from a lower surface of the support part; a connector member having a connector body, a bridge, and a securing ring, where the connector body may have a hollow interior such that a connector space that is open at the top and bottom is formed on an inner side of the securing ring, the connector body may be configured such that an upper end is exposed at each of the left side and right side so as to form an exposed rim, the bridge may extend upward from an upper portion of the connector body at each of the front side and rear side of the connector body, the securing ring may be formed at an upper portion of the bridge at a position separated from the exposed rim and may have an annular shape such that a restricting hole configured to receive the gear shaft is formed on an inner side of the securing ring; and a screw socket member configured to have at least a portion inserted in the connector space, where the screw socket member may have a hollow interior such that a screw space open at the top and bottom is formed on an inner side of the screw socket member, and the screw socket member may have an outwardly protruding detent protrusion formed on its upper portion.

An elevating mechanism according to an embodiment of the present invention can include one or more of the following features. For example, a clearance slit can be formed in an upper portion of the connector body, where the clearance slit can extend downward from an upper end of the connector body to a particular depth, and the clearance slit can be formed between a portion where the exposed rim is formed and a portion where the bridge is formed.

The elevating mechanism can further include a shell member that extends along a vertical direction and has a hollow interior such that a shell space open at a top and a bottom is formed on its inner side. The support part can be configured to move along a vertical direction within the shell space, and a coupling hole can be formed on one side of the shell member. A coupling protrusion configured to be inserted into the coupling hole can be formed on one side of the connector body, where an upper portion of the coupling protrusion can form a sloped surface, and a lower portion of the coupling protrusion can form a curb.

A clearance slit can be formed in one side of the shell member, and the clearance slit can extend downward from a particular position below the coupling hole to a lower end of the shell member. On another side of the shell member, a guide slit can be formed that extends downward from a particular position to a lower end of the shell member.

A sloped surface that leads to the restricting hole can be formed on an inner side of an upper portion of the securing ring.

The distance between the inner surfaces of the bridge located at the front side and the rear side of the connector body can be set to be greater than the outer diameter of the detent protrusion.

A thread can be formed at an upper portion of the screw space, and the screw socket member can be configured to permit elastic deformation at the portion where the thread is formed.

Another aspect of the present invention can provide a stick type container that includes the elevating mechanism for a stick type product described above.

An embodiment of the present invention having the features above can provide various advantageous effects including the following. However, an embodiment of the present invention may not necessarily exhibit all of the effects below.

An elevating mechanism and a stick type container having the elevating mechanism according to an embodiment of the present invention can be assembled in a simpler manner, so that manufacturing costs may be reduced.

DETAILED DESCRIPTION OF THE INVENTION

Figure 1A:
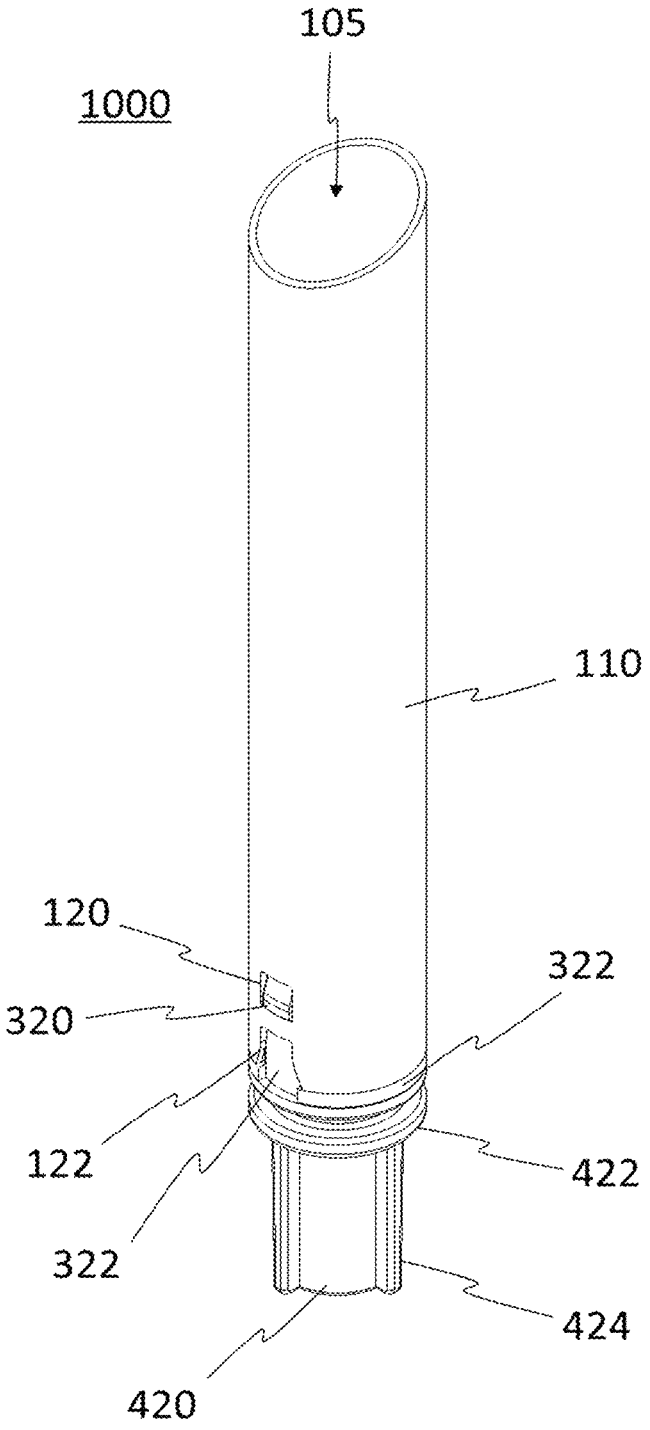
FIG. 1A and FIG. 1B are perspective views illustrating an elevating mechanism for a stick type product according to an embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

For convenience, the specification uses terms such as "inner", "outer", "front", "rear", "left", "right", "upper", and "lower". In the descriptions below, an "inner" side refers to a side closer to the interior of the elevating mechanism 1000, whereas an "outer" side refers to a side further away from the interior of the elevating mechanism 1000. The terms "front", "rear", "left", "right", "upper", and "lower" are used to describe the elevating mechanism 1000 when it is oriented as in FIG. 8A, in which the portion where the coupling protrusion 320 is formed is regarded as the front of the elevating mechanism 1000, and the screw socket member 400 is facing downward. Of course, when an elevating mechanism 1000 according to an embodiment of the invention is actually in use, the directions mentioned in the specification may not coincide with the actual directions of the parts described.

Certain embodiments of the present invention will be described below in more detail with reference to the accompanying drawings. Those components that are the same or are in correspondence are rendered the same reference numeral, and redundant descriptions are omitted.

Figure 1B:
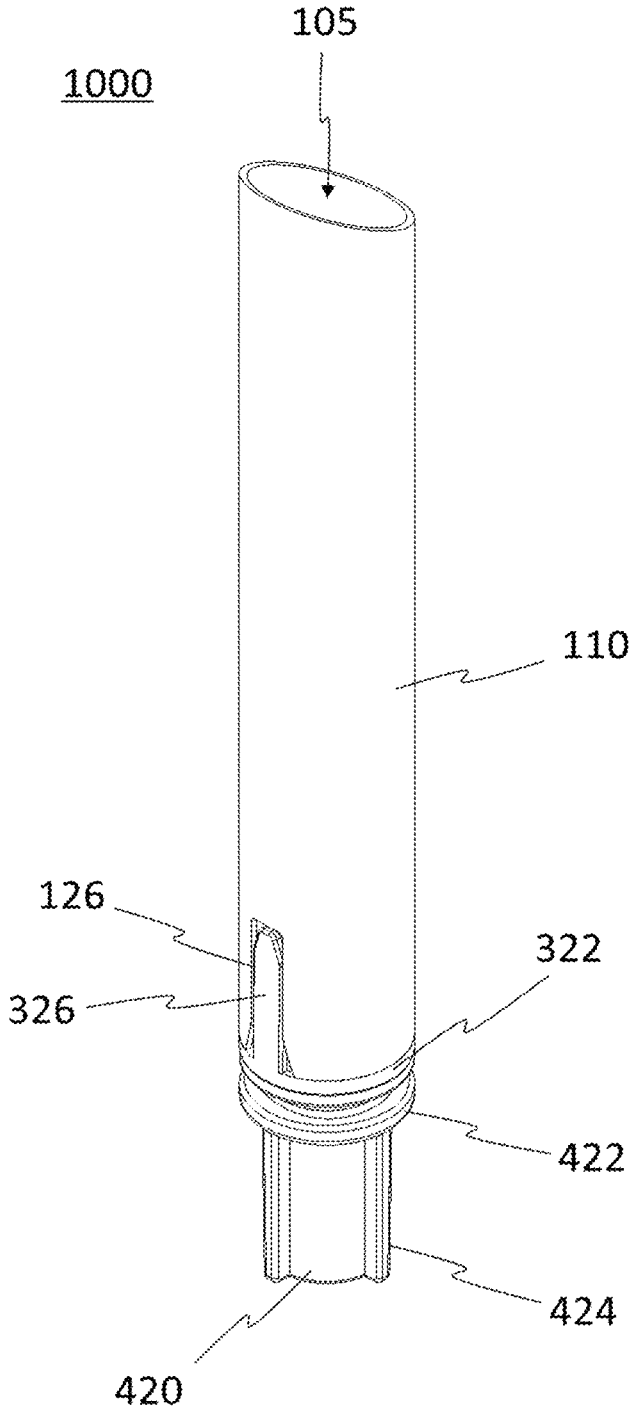
Figure 2:
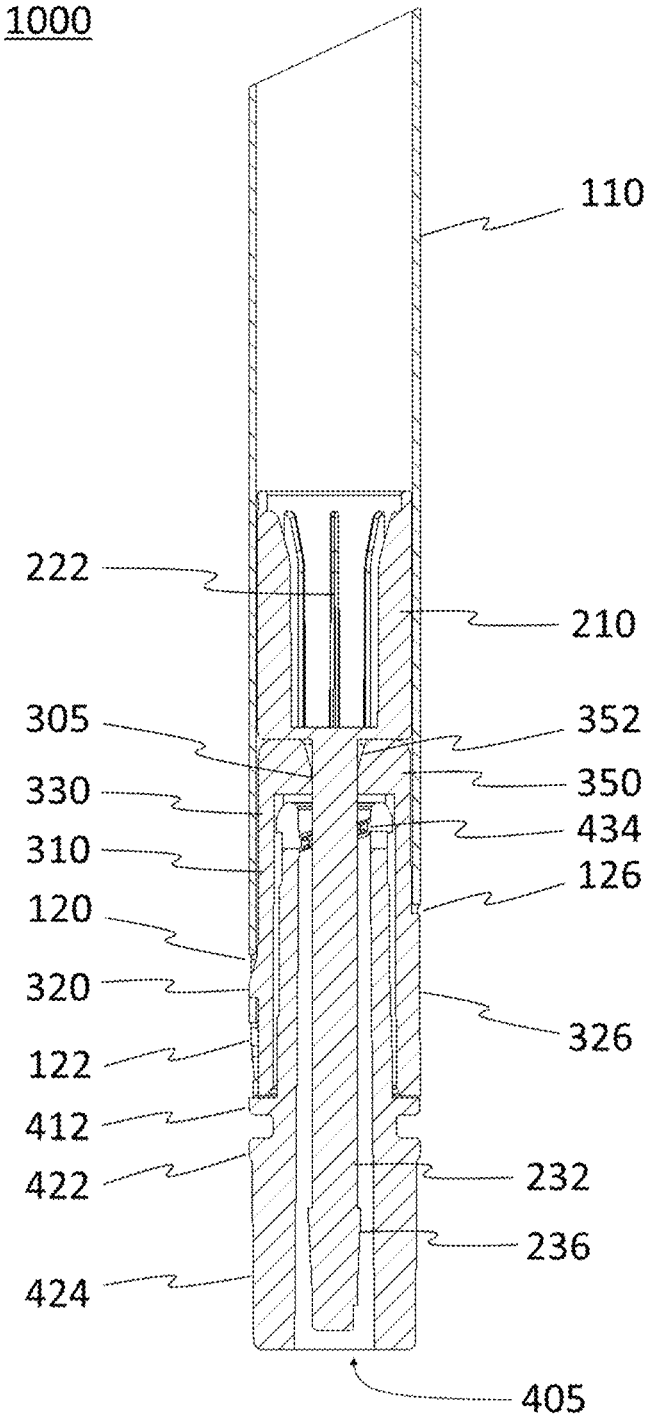
FIG. 2 is a cross-sectional view illustrating the elevating mechanism shown in FIG. 1A and FIG. 1B.
Figure 3:
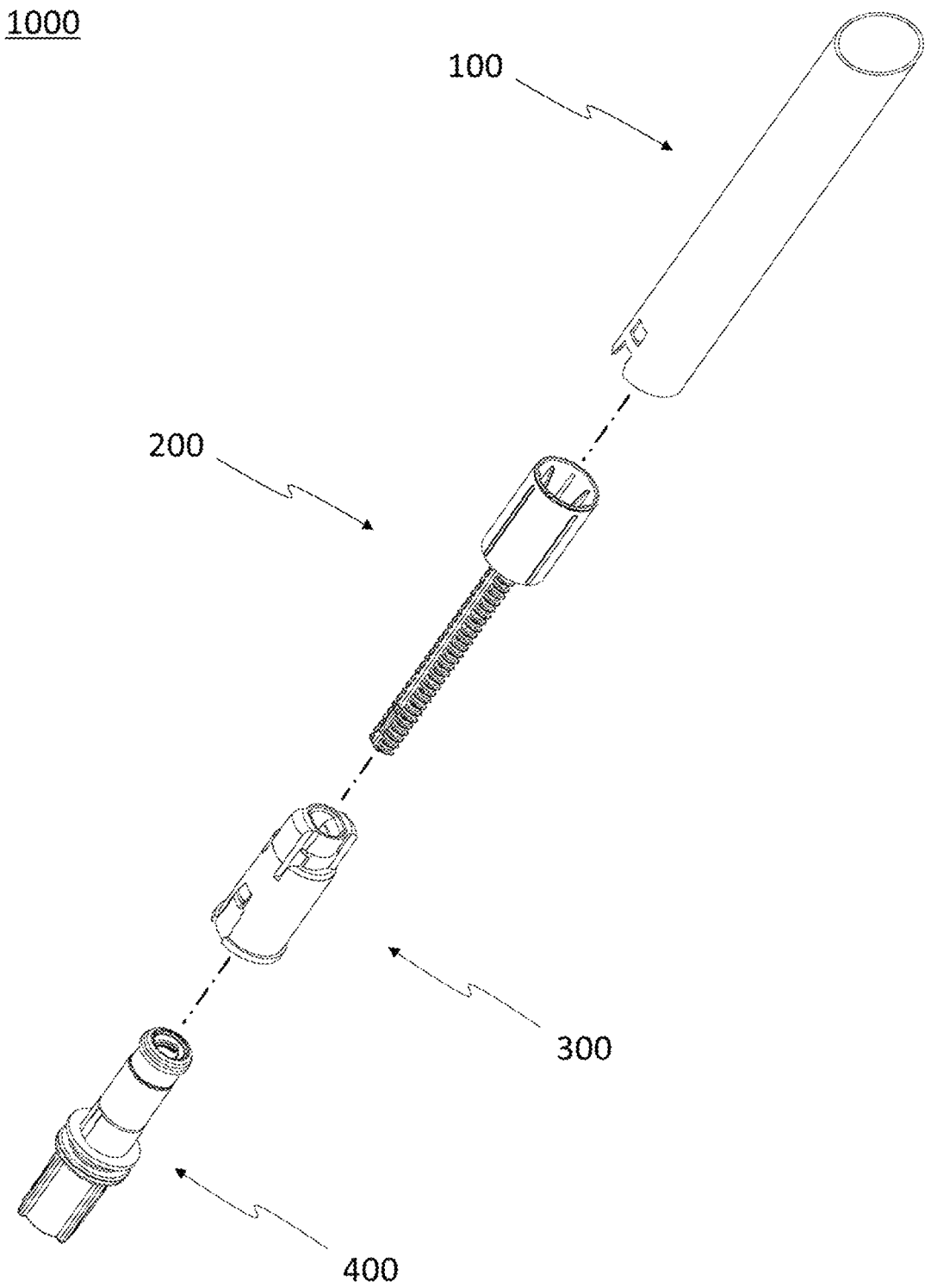
FIG. 3 is an exploded perspective view illustrating the elevating mechanism shown in FIG. 1A and FIG. 1B.
Figure 4A:
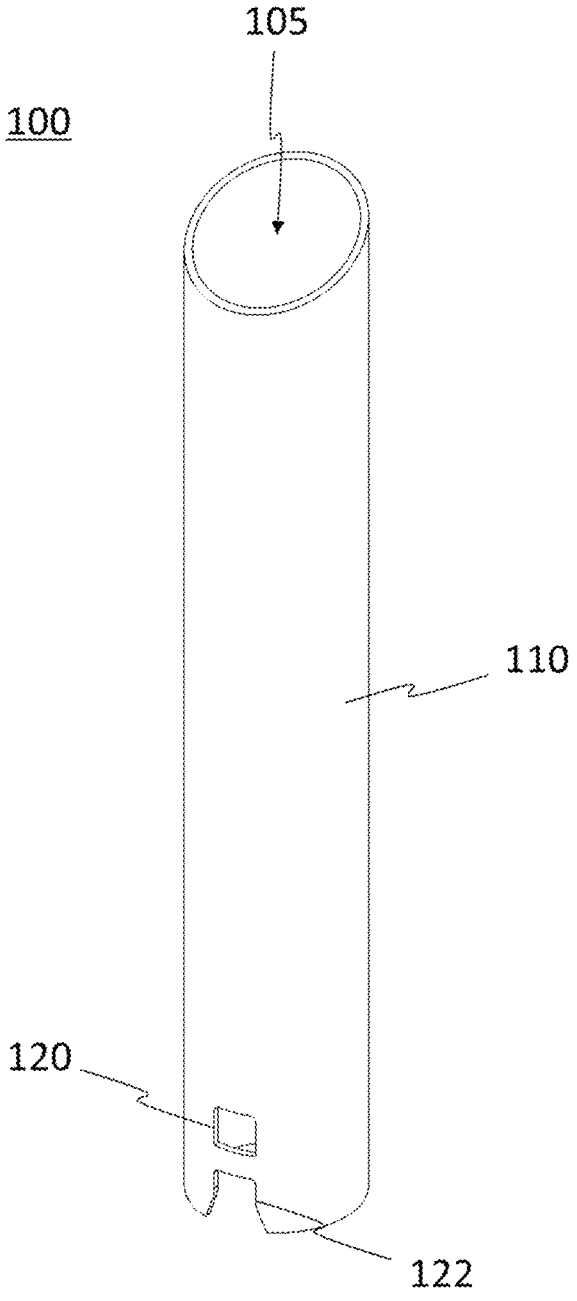
FIG. 4A and FIG. 4B are perspective views illustrating the shell member of the elevating mechanism shown in FIG. 1A and FIG. 1B.
Figure 4B:
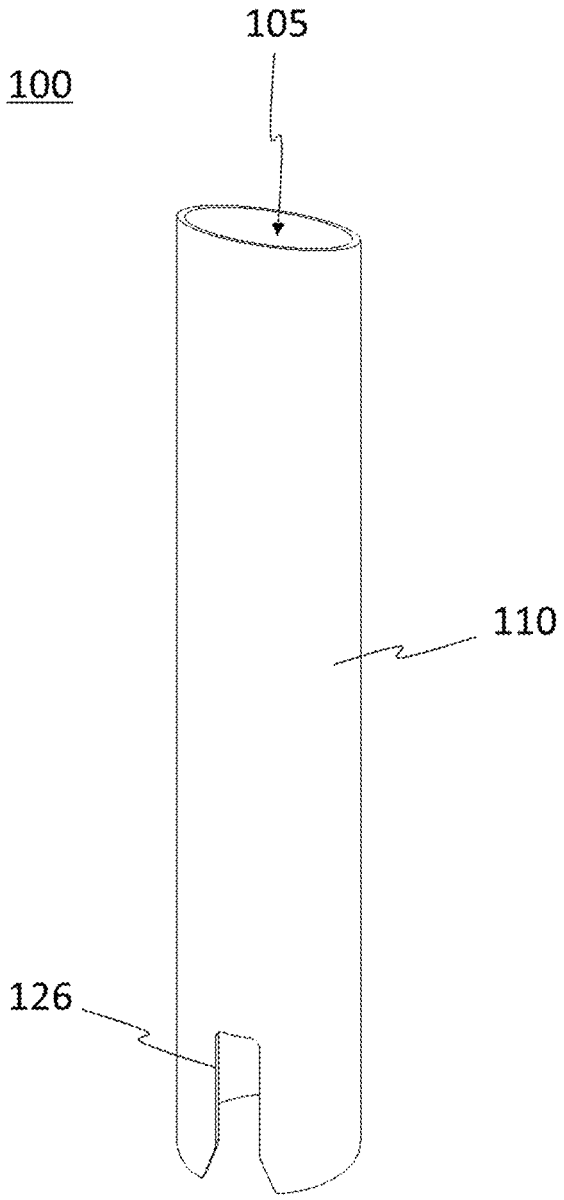
Figure 5:
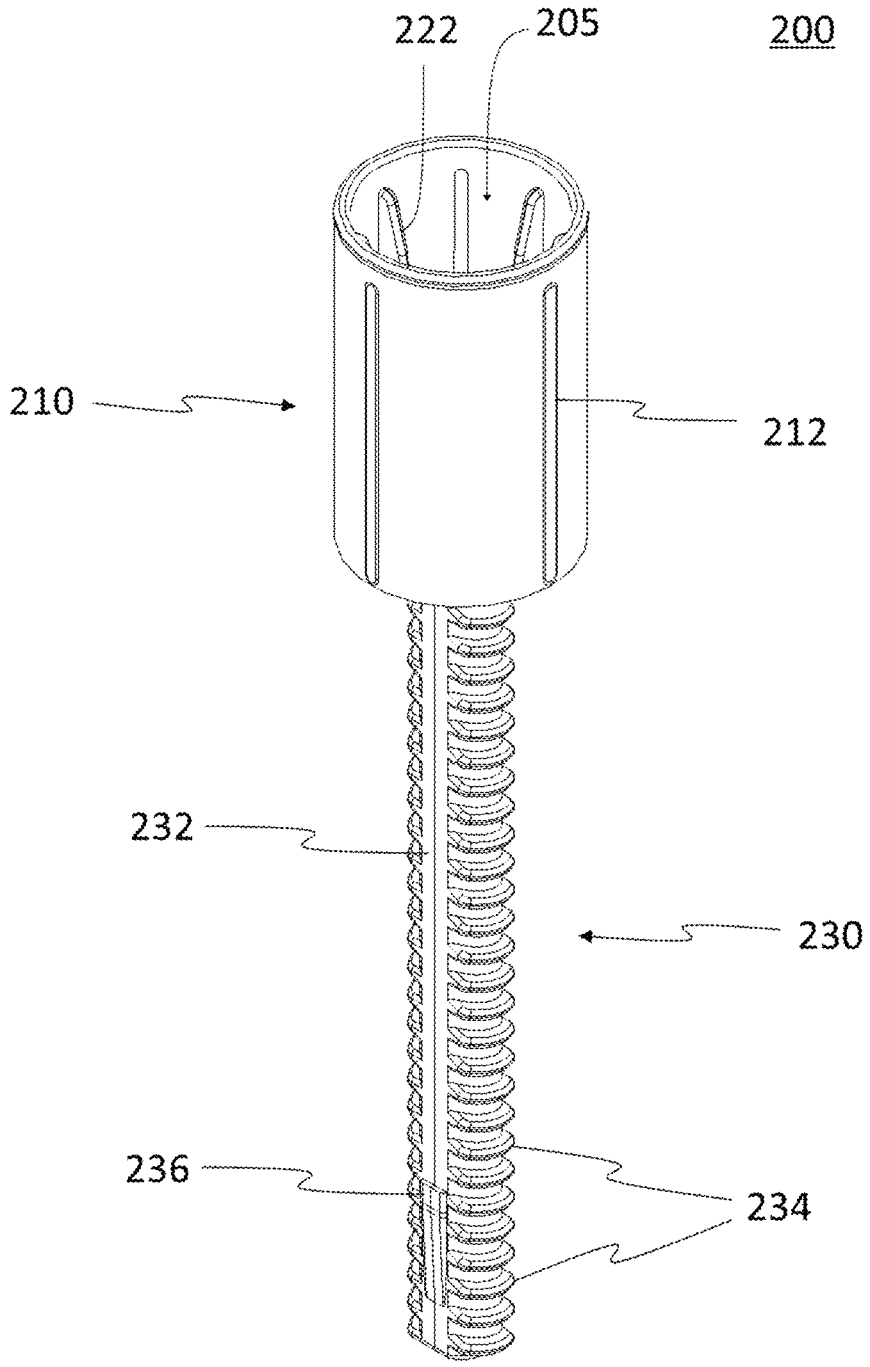
FIG. 5 is a perspective view illustrating the holder member of the elevating mechanism shown in FIG. 1A and FIG. 1B.
Figure 6A:
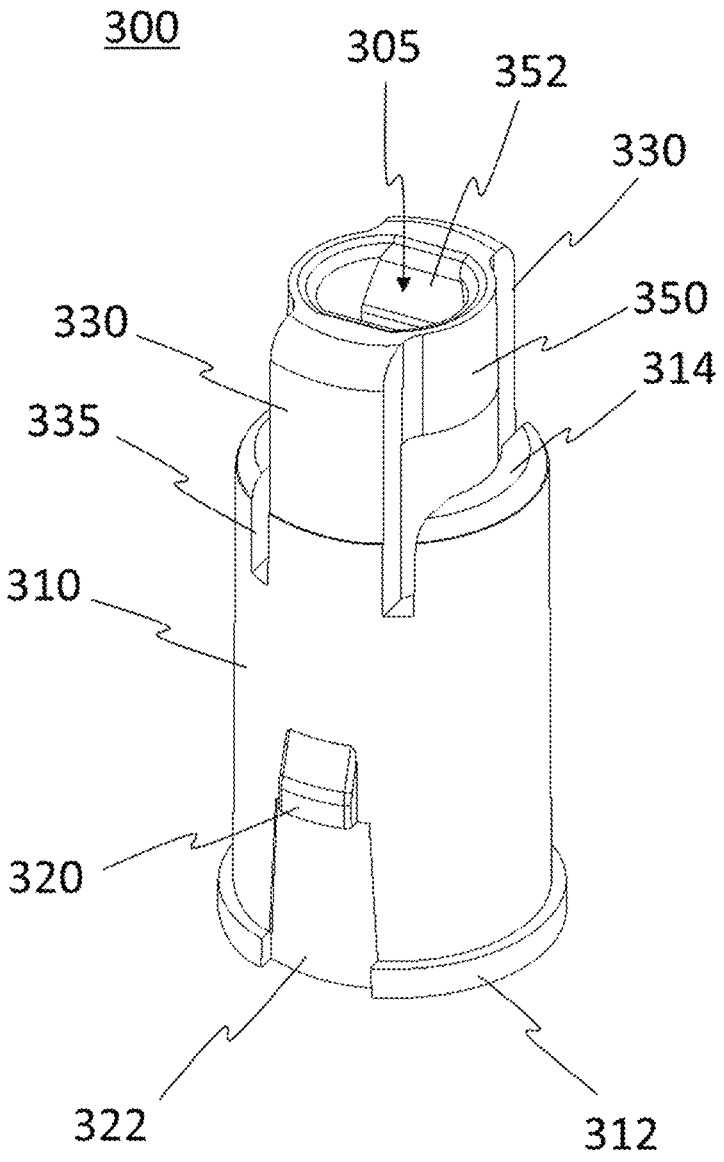
FIG. 6A, FIG. 6B, and FIG. 6C illustrate the connector member of the elevating mechanism shown in FIG. 1A and FIG. 1B.
Figure 6B:
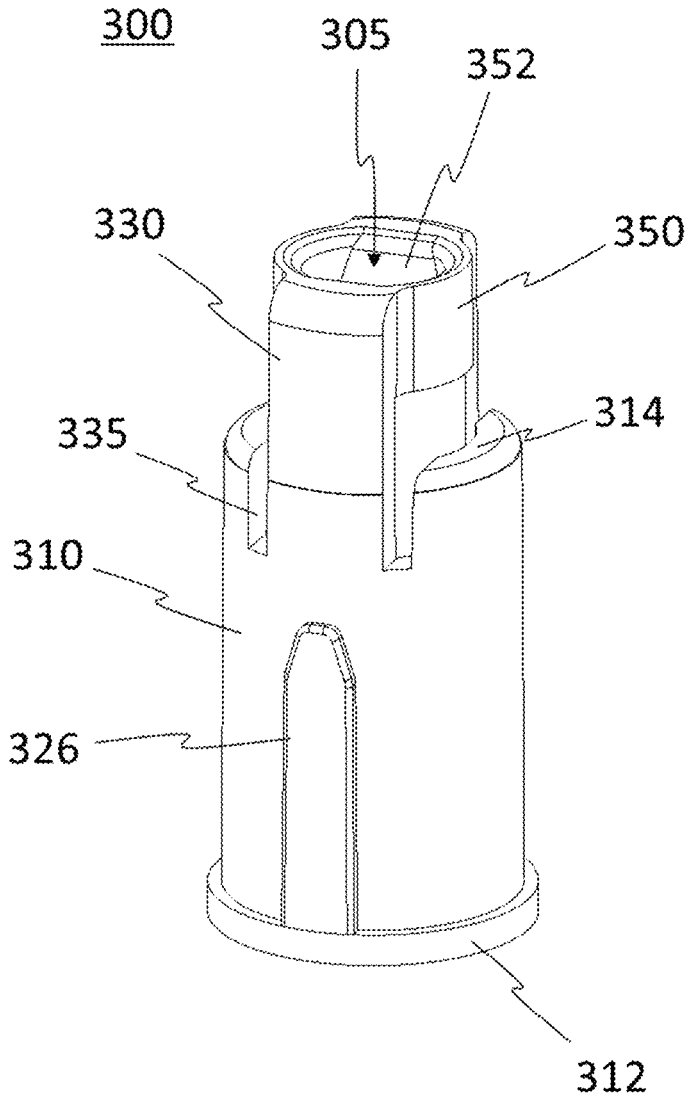
Figure 6C:
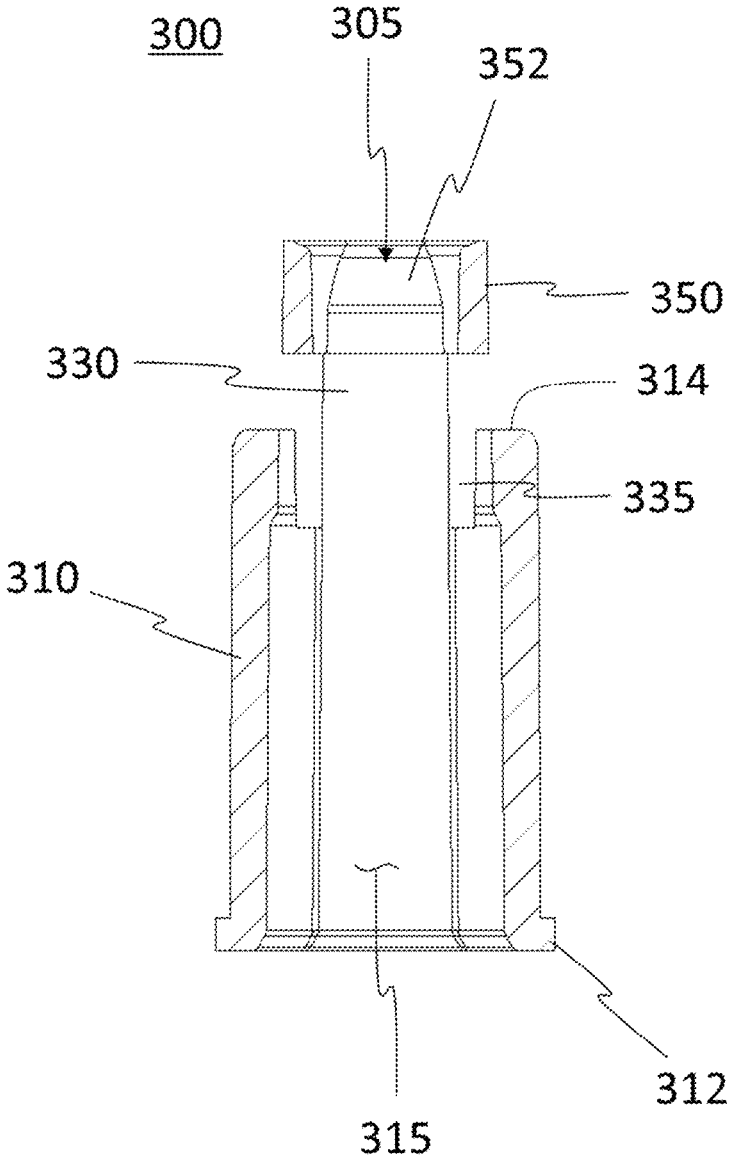
Figure 7:
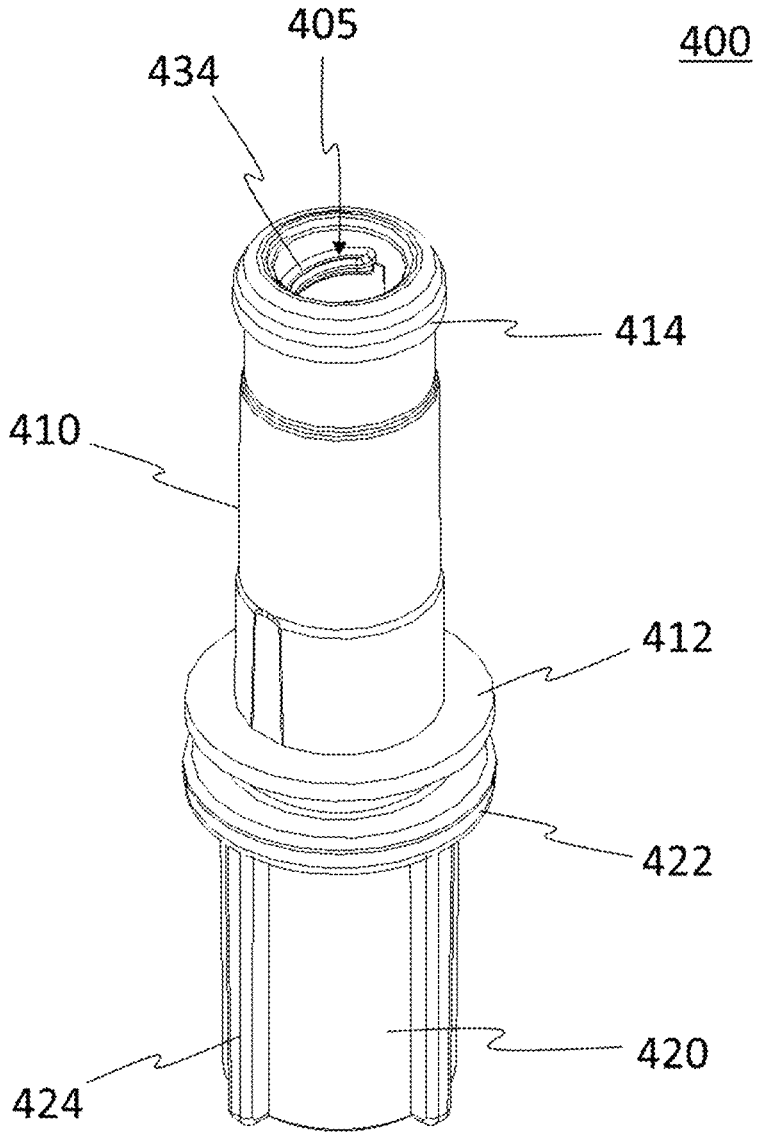
FIG. 7 is a perspective view illustrating the screw socket member of the elevating mechanism shown in FIG. 1A and FIG. 1B.
Figure 8A:
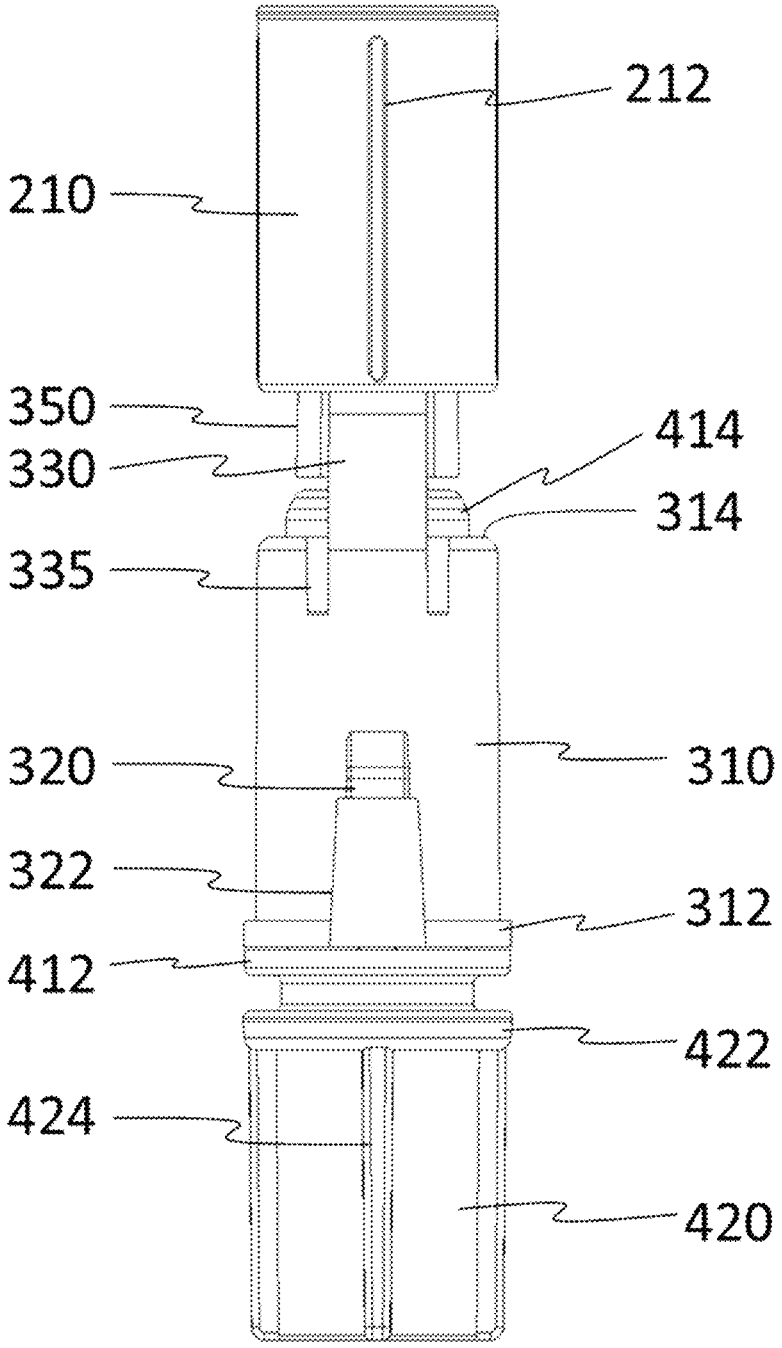
FIG. 8A and FIG. 8B illustrate the holder member, connector member, and screw socket member of the elevating mechanism shown in FIG. 1A and FIG. 1B in an assembled state.
Figure 8B:
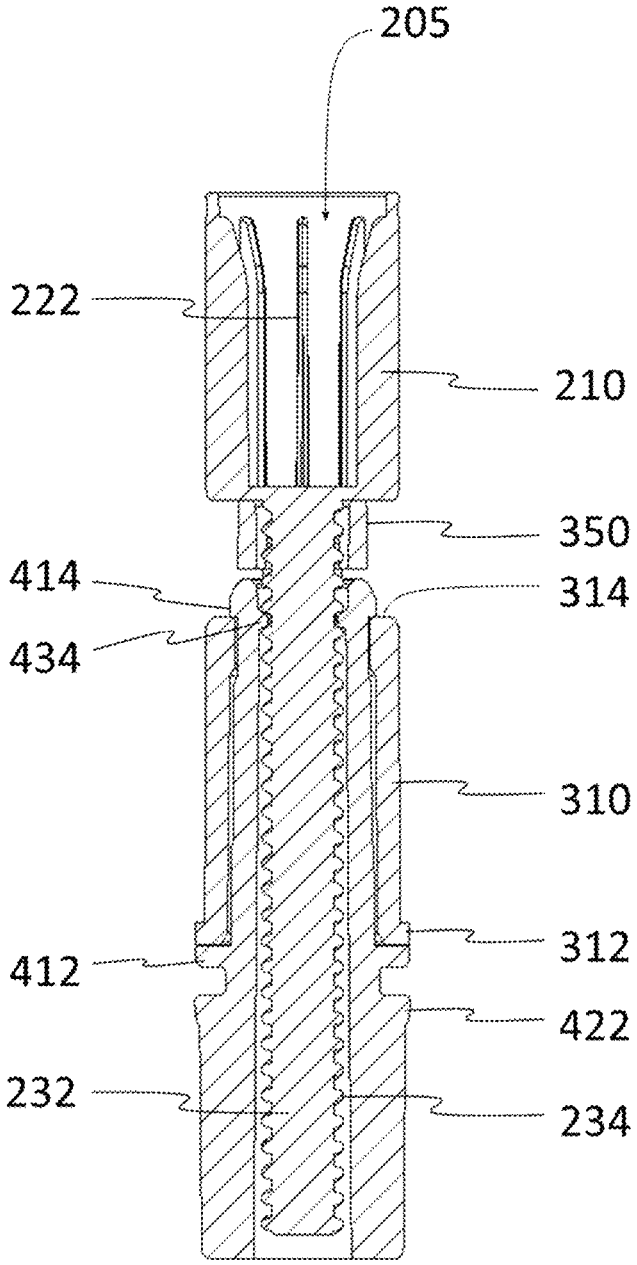

FIG. 1A and FIG. 1B are perspective views illustrating an elevating mechanism 1000 for a stick type product according to an embodiment of the invention, while FIG. 2 and FIG. 3 are a cross-sectional view and an exploded perspective view illustrating the elevating mechanism 1000. FIG. 4A and FIG. 4B provide a more detailed view of the shell member 100, FIG. 5 provides a more detailed view of the holder member 200, FIGS. 6A to 6C provide a more detailed view of the connector member 300, and FIG. 7 provides a more detailed view of the screw socket member 400. FIG. 8A and FIG. 8B illustrate the holder member 200, connector member 300, and screw socket member 400 of the elevating mechanism 1000 in an assembled state.

A stick type container according to an embodiment of the invention may be a container that holds a stick material (not shown; also referred to herein simply as "stick") such as a lipstick, lip balm, etc., for use by the user. The stick type container may use an elevating mechanism 1000 to move a holder member 200, which supports the stick material (not shown), along a vertical direction within the shell space 105 of a shell member 100. A stick type container according to an embodiment of the invention can further include a lower case (not shown) and an overcap (not shown) that house the elevating mechanism 1000. Of course, in certain embodiments, the stick type container can be complete just with a stick material (not shown) filled in the elevating mechanism 1000. As shown in the drawings, an elevating mechanism 1000 for a stick type product according to an embodiment of the invention can mainly include a shell member 100, a holder member 200, a connector member 300, and a screw socket member 400.

The shell member 100 can extend along a vertical direction, and a shell space 105 that is open at the top and bottom may be formed on the inner side of the shell member 100. The holder member 200, which can be elevated and lowered by the elevating mechanism 1000, and the stick (not shown), which is supported on the holder member 200, may be moved along the vertical direction within the shell space 105. A shell body 110, which corresponds to the main part of the shell member 100, can be generally shaped as a hollow cylinder, and the shell space 105 can be formed in the hollow interior. In applications where the stick type container is used as a lipstick container, etc., the shell body 110 can be shaped as if the upper portion is cut away along a sloped plane, and various other design elements can be included for an aesthetic appearance.

FIG. 4A shows the front of the shell member 100, while FIG. 4B shows the rear of the shell member 100. As illustrated in FIG. 4A, a coupling hole 120 can be formed on one side of the shell body 110, which serves as the main part of the shell member 100. The coupling hole 120 can be formed in a lower portion on one side of the shell body 110 for example, and a coupling protrusion 320 of the connector member 300 can be inserted in the coupling hole 120.

In the shell body 110, a clearance slit 122 can be formed below the coupling hole 120. The clearance slit 122 can extend downward from a particular position below the coupling hole 120 to the lower end of the shell body 110 and can be shaped such that a lower part of the clearance slit 122 opens wider towards the bottom. As the clearance slit 122 is located below the coupling hole 120, the portion of the shell body 110 directly under coupling hole 120 can have a shorter length along the vertical direction. This can make it easier for elastic deformation to occur when the coupling protrusion 320 of the connector member 300 enters the coupling hole 120, so that the coupling protrusion 320 may enter more easily.

As illustrated in FIG. 4B, a guide slit 126 can be formed on another side of the shell body 110. The guide slit 126 can be formed for example in a lower portion on the other side of the shell body 110, and a guide protrusion 326 of the connector member 300 can be inserted in the guide slit 126. The guide slit 126 can extend downward from a particular position of the shell body 110 to the lower end of the shell body 110 and can be shaped such that a lower part of the guide slit 126 opens wider towards the bottom. The guide slit 126 and the guide protrusion 326 can facilitate the aligning and coupling of the connector member 300 with respect to the shell member 100. As the guide slit 126 is located on the other side of the shell body 110, the elastic deformation at the one side of the shell body 110 can occur more easily, so that the coupling protrusion 320 at the one side of the shell body 110 may more easily move across the portion of the shell body 110 below the coupling hole 120.

The holder member 200 is the portion that directly supports the stick material (not shown), which corresponds to the content of the stick type container. An elevating mechanism 1000 according to an embodiment of the invention can elevate and lower the holder member 200 within the shell member 100 and thus enable the user to adjust the amount of stick material (not shown) exposed at the top of the shell member 100. FIG. 5 is a perspective view illustrating the holder member 200 of the elevating mechanism 1000 shown in FIG. 1A and FIG. 1B. As illustrated in FIG. 5, the holder member 200 can mainly include a support part 210 and a gear shaft 230.

The support part 210 is the part supporting the stick (not shown). As illustrated in FIG. 2, the support part 210 can be implemented in the shape of a cup that is open at the top and can thus form a holder space 205 on its inner side. The support part 210 may move along the vertical direction within the shell space 105 of the shell member 100 while supporting the stick material (not shown). In order that the support part 210 may move more easily within the shell space 105, a multiple number of contact protrusions 212 can be formed on the outer perimeter of the support part 210. The contact protrusions 212 can prevent the occurrence of excessive friction between the support part 210 and the shell body 110.

The support part 210 can house the stick material (not shown); for example, the lower end of the stick material (not shown) can be housed in the cup-shaped holder space 205. One or more securing protrusions 222 can be formed on the inner side of the support part 210 facing the holder space 205, where the securing protrusions 222 can prevent the stick material (not shown) from becoming detached from the support part 210. Although the drawings illustrate the support part 210 as having a cup-like shape to form the holder space 205 on its inside, it is possible to implement the support part 210 in various forms as long as the stick (not shown) can be supported by the support part 210.

The gear shaft 230 can extend downward from a lower surface of the support part 210. The gear shaft 230 can interact with the screw socket member 400 to enable the holder member 200 to move along the vertical direction. As illustrated in FIG. 5, the gear shaft 230 can include a shaft body 232, which may extend along the vertical direction, and gear cogs 234 and stopper protrusions 236, which may be formed on the shaft body 232.

The shaft body 232 can extend downward from a lower surface of the support part 210 and can pass through a restricting hole 305 of the connector member 300 to be inserted into the screw space 405 of the screw socket member 400 as in the example illustrated in FIG. 2. The shaft body 232 can have a cross section that is not circular, and the restricting hole 305 of the connector member 300 can have a shape corresponding to the non-circular cross section of the shaft body 232. Since the cross section of the shaft body 232 and the shape of the restricting hole 305 are not circular, the restricting hole 305 of the connector member 300 does not allow the shaft body 232 to rotate.

The gear cogs 234 formed on the shaft body 232 can be configured to mate with the thread 434 formed in the screw space 405 of the screw socket member 400. In applications where the cross section of the shaft body 232 is longer in a particular direction, as in the example shown in the drawings, the gear cogs 234 can be formed on both sides with respect to said particular direction. When the screw socket member 400 is rotated by the user, the restricting hole 305 of the connector member 300 will not allow the shaft body 232 to rotate, and therefore the gear cogs 234 may move along the thread 434 of the screw space 405, causing the entire holder member 200 to move along the vertical direction in the manner of a lead screw. Although the drawings illustrate an example in which the gear cogs 234 are formed on the shaft body 232 and the thread 434 is formed in the screw space 405, it is also possible to form the thread on the shaft body 232 and form the gear cogs in the screw space 405. In such applications, the structure for preventing the rotation of the holder member 200 in relation to the screw socket member 400 may require modifications.

The stopper protrusions 236 formed on the shaft body 232 can serve to prevent the holder member 200 from moving excessively upward to such an extent that the connector member 300 becomes detached from the screw socket member 400. In applications where the cross section of the shaft body 232 is longer in a particular direction, as in the example shown in the drawings, the stopper protrusions 236 can be formed on one or both sides with respect to the direction in which the cross section of the shaft body 232 is shorter. When the screw socket member 400 is rotated by the user, the holder member 200 can move upward, but if the user inadvertently rotates the screw socket member 400 excessively such that the holder member 200 reaches the highest permissible position, the stopper protrusions 236 may be caught on the lower surface of the securing ring 350. Since the stopper protrusions 236 are thus unable to pass through the restricting hole 305, the holder member 200 can be prevented from moving further upward and thus can be prevented from becoming detached.

As illustrated in FIG. 5, the stopper protrusions 236 can have a very gradual slope on its lower side and can form a curb on its upper side. Such shape allows the gear shaft 230 including the stopper protrusions 236 to pass through the restricting hole 305 with relative ease, when the gear shaft 230 is moved downward for the assembly of the elevating mechanism 1000, but prevent the gear shaft 230 from passing through the restricting hole 305, when the gear shaft 230 is moved upward during the use of the elevating mechanism 1000. The lengths and positions of the stopper protrusions 236 can be designed such that the distance from the curb on the upper side of each stopper protrusion 236 to the lower end of the shaft body 232 is greater than or equal to the distance from the lower surface of the securing ring 350 to the upper end of the screw socket member 400. Therefore, when the curbs on the upper portions of the stopper protrusions 236 are caught on the lower surface of the securing ring 350, the lower end of the shaft body 232 can remain within the screw space 405 of the screw socket member 400. Thus, if the user rotates the screw socket member 400 in an opposite direction, the holder member 200 can move back downward.

The connector member 300 is the part that connects the shell member 100 with the screw socket member 400 and keeps the shell member 100 and the screw socket member 400 coupled in a relatively rotatable state. FIGS. 6A to 6C illustrate the connector member 300 of the elevating mechanism 1000 shown in FIG. 1A and FIG. 1B, where FIG. 6A is a front view of the connector member 300, FIG. 6B is a rear view of the connector member 300, and FIG. 6C is a cross-sectional view of the connector member 300 when seen from the front or rear. Referring to FIGS. 6A to 6C, the connector member 300 can be regarded as including a connector body 310, bridges 330, and a securing ring 350.

The connector body 310 can form the main part of the connector member 300 and can have a hollow interior so as to form a connector space 315 on its inner side, with the connector space 315 open at the top and bottom. Since the connector member 300 itself is not a part that is rotated relatively to the shell member 100, it is not necessary for the connector body 310 to have a cylindrical shape. However, the screw socket member 400, which is inserted into the connector space 315, is a part that is rotated, and as such, the connector space 315 can have a circular cross section. The connector body 310 can be shaped such that its diameter decreases towards the top in a gradual and/or stepwise manner in correspondence to the insertion part 410 of the screw socket member 400 that is inserted therein.

A base curb 312 can be formed on the lower end of the connector body 310. When the connector body 310 is inserted into the lower portion of the shell space 105, the lower end of the shell body 110 can be placed on the base curb 312. Also, a securing recess 322 can be formed on one side in a lower portion of the connector body 310. The securing recess 322 can be formed below the coupling protrusion 320 and can be shaped as if the outer perimeter of the connector body 310 is recessed inward. At the portion where the securing recess 322 is formed, the base curb 312 can be omitted. When the shell member 100 is coupled to the connector member 300, the clearance slit 122 of the shell body 110 can overlap the securing recess 322 of the connector body 310, and these can be used for aligning and/or coupling the elevating mechanism 1000 with another member such as a lower case (not shown), an overcap (not shown), or the like.

The bridges 330 can be formed on certain parts of the upper portion of the connector body 310, while, on the remaining parts, the upper end of the connector body 310 can be exposed so as to form exposed rims 314. For example, if the part where the coupling protrusion 320 is formed on the connector member 300 is regarded as the front of the connector member 300, then on the front and rear sides of the connector body 310, the bridges 330 can be formed on the upper portion of the connector body 310 such that the connector body 310 continues to the bridges 330 without forming an exposed upper rim, whereas on the left and right sides of the connector body 310, the bridges 330 may not be formed, leaving the exposed rims 314.

As illustrated in FIG. 6C and FIG. 8B, the exposed rims 314 can protrude inwardly compared to the remaining portions of the connector body 310, and the lower portions of the inner surfaces of the exposed rims 314 can be sloped. The exposed rims 314 can detain the screw socket member 400 and can be used to couple the screw socket member 400 to the connector member 300.

On the upper portion of the connector body 310, a clearance slit 335 can be formed between each bridge 330 and each exposed rim 314. The clearance slits 335 of the connector body 310 can extend downward from the upper end of the connector body 310 to a particular depth.

Referring to FIG. 6A, a coupling protrusion 320 can be formed on one side of the connector body 310, and when the shell member 100 and the connector member 300 are coupled together, the coupling protrusion 320 can be inserted into the coupling hole 120 of the shell member 100 described above. An upper portion of the coupling protrusion 320 can form a sloped surface, and a lower portion of the coupling protrusion 320 can form a curb. When the connector member 300 is inserted into the shell member 100 for assembly, the shape of the coupling protrusion 320 allows the coupling protrusion 320 to pass over the portion of the shell body 110 under the coupling hole 120 relatively easily but prevents the coupling protrusion 320 from leaving the coupling hole 120 once it has been inserted completely. The coupling protrusion 320 and the coupling hole 120 can serve to couple the connector member 300 to the shell member 100 without permitting relative rotation.

Referring to FIG. 6B, a guide protrusion 326 can be formed on the other side of the connector body 310, and when the shell member 100 and the connector member 300 are coupled together, the guide protrusion 326 can be inserted into the guide slit 126 of the shell member 100 described above. The guide protrusion 326 can have a shape corresponding to that of the guide slit 126 and, similarly to the guide slit 126, can extend downward from a particular position of the connector body 310 to the lower end of the connector body 310. The guide protrusion 326 can aid the coupling and aligning of the shell member 100 and connector member 300 and, in particular, can aid in coupling the connector member 300 to the shell member 100 in a manner that does not allow relative rotation.

The bridges 330 can extend upward from the upper portion of the connector body 310 at one side and the other side of the connector body 310 to connect the connector body 310 with the securing ring 350. The outer surface and inner surface of each bridge 330 can continue from the outer surface and inner surface of the connector body 310.

The securing ring 350 can be formed on the upper portions of the bridges 330. As illustrated in FIGS. 6A to 6C, the securing ring 350 can be formed at a position separated from the exposed rim 314 with respect to the vertical direction, and as illustrated in FIG. 2, FIG. 8A, and FIG. 8B, the securing ring 350 can be formed at a position separated from the upper end of the screw socket member 400. The securing ring 350 can have an annular shape, and a restricting hole 305 can be formed on its inner side through which the gear shaft 230 may pass through. Since the restricting hole 305 is formed to allow the shaft body 232 to pass through and the connector space 315 is formed to house the screw socket member 400, the sizes of the restricting hole 305 and the securing ring 350 can be smaller compared to the sizes of the connector space 315 and the connector body 310.

A sloped surface 352 that connects to the restricting hole 305 can be formed on the inner surface of an upper portion of the securing ring 350. The sloped surface 352 can, for example, be formed to face the restricting hole 305 at the front and rear sides of the restricting hole 305, so that the restricting hole 305 can have a shape corresponding to the cross section of the shaft body 232, of which the shape has an elongated form along the left and right directions.

The screw socket member 400 can be rotatably coupled to the connector member 300 and can be rotated by the user when an elevating or lowering of the stick material (not shown) is required. FIG. 7 is a perspective view illustrating the screw socket member 400 of the elevating mechanism 1000 shown in FIG. 1A and FIG. 1B. As illustrated in FIG. 7, the screw socket member 400 can basically include an insertion part 410 and a manipulation part 420, and as illustrated in FIG. 2, a screw space 405 can be formed on the inner side along the entirety of or a portion of the screw socket member 400.

The insertion part 410 is the part that is inserted into the connector space 315 of the connector member 300. The screw socket member 400 is a part that is rotated in relation to the shell member 100, holder member 200, and connector member 300, and the insertion part 410 in particular, which is inserted into the connector space 315, may preferably have a cross section that is circular or close to circular in shape overall. The insertion part 410 can have a diameter that decreases towards the top in a gradual and/or stepwise manner. Such shape prevents the insertion part 410 from having an excessively large difference in diameter between the top and bottom, even though a detent protrusion 414 protrudes outward at an upper portion of the insertion part 410.

A flange 412 can be formed on the insertion part 410. When the screw socket member 400 is inserted into the connector member 300, the lower end of the connector body 310 can be placed on the flange 412.

A detent protrusion 414 can be provided on an upper end of the insertion part 410. The detent protrusion 414 can protrude outward from an upper portion of the insertion part 410 so as to have an annular shape overall. As illustrated in FIG. 7, the detent protrusion 414 can form a sloped surface on the outer side at its upper portion and can form a curb at its lower surface. The length by which the detent protrusion 414 protrudes outward can be designed such that the detent protrusion 414 may be caught on the exposed rims 314 of the connector member 300 but does not contact the bridges 330.

The manipulation part 420 is the part that is positioned under the connector member 300 and is rotated by the user. As described above, the elevating mechanism 1000 illustrated in the drawings can be housed within a separate lower case (not shown), and the user does not necessarily have to directly rotate the manipulation part 420 of the screw socket member 400 itself. A multiple number of grip protrusions 424 can be formed on the outer perimeter of the manipulation part 420. The grip protrusions 424 allow the user to more easily rotate the manipulation part 420. The grip protrusions 424 can be inserted in corresponding slots formed in a lower case (not shown) or can be gripped by the user directly. A flange 422 can be provided also on the manipulation part 420. If the screw socket member 400 is inserted in a lower case (not shown), etc., the flange 422 can allow the screw socket member 400 to be placed in a designated position.

A screw space 405 can be formed on the inner side of the screw socket member 400, and a thread 434 can be formed on the inner perimeter of the screw space 405. As described above, the gear cogs 234 formed on the gear shaft 230 of the holder member 200 may interact with the thread 434 of the screw space 405, thereby causing the holder member 200 to move along the vertical direction in the manner of a lead screw.

In an embodiment of the invention, the thread 434 can be formed in a particular position on an upper portion of the screw space 405, and the screw socket member 400 can be configured to permit elastic deformation at the portion where the thread 434 is formed. This structure makes it possible, when inserting the gear shaft 230 of the holder member 200 into the screw space 405, to couple the holder member 200 to the screw socket member 400 without having to rotate the gear cogs 234 along the thread 434 by simply pushing the gear shaft 230 downward, as the thread 434 may move to the sides of the gear cogs 235 due to the elastic deformation of the screw socket member 400.

The following provides a more detailed description of the processes for assembling and using an elevating mechanism 1000 based on an embodiment of the invention.

Manufacturing an elevating mechanism 1000 according to an embodiment of the invention can first involve fabricating each of the shell member 100, holder member 200, connector member 300, and screw socket member 400. A stick material (not shown) corresponding to the content of the stick type product can be provided on the support part 210 of the holder member 200. The manufacturer or manufacturing apparatus can first insert the screw socket member 400 into the connector space 315 of the connector member 300.

The manufacturer or manufacturing apparatus can move the screw socket member 400 upward from below the connector member 300 to insert the insertion part 410 into the connector space 315. As the screw socket member 400 is inserted deeper, the inner diameter of the connector space 315 may become smaller than the outer diameter of the detent protrusion 414, but the clearance slits 335 formed in the connector body 310 can permit slight elastic deformations in the upper portion of the connector body 310, thereby expanding the connector body 310 and allowing the detent protrusion 414 to pass through. When the screw socket member 400 reaches a designated position, the detent protrusion 414 may move to the top of the exposed rims 314, at which the connector body 310 may return to its original state, and the lower surface of the detent protrusion 414 may contact the upper surfaces of the exposed rims 314. In this way, the screw socket member 400 can be rotatably coupled to the connector member 300.

Then the manufacturer or manufacturing apparatus can couple the connector member 300 and screw socket member 400 to the holder member 200.

The manufacturer or manufacturing apparatus can move the holder member 200 downward from above the connector member 300 to insert the gear shaft 230 through the restricting hole 305 of the connector member 300. Since the restricting hole 305 is formed in a shape and size corresponding to those of the gear shaft 230, the restricting hole 305 may not hinder the entry of the gear shaft 230 overall when the gear shaft 230 is aligned in the proper direction. As the stopper protrusions 236 on the lower portion of the gear shaft 230 have gradual slopes, they may pass through the restricting hole 305 without difficulty, and after the stopper protrusions 236 have passed through, the stopper protrusions 236 may not easily be separated from the restricting hole 305 due to the curbs formed on the upper portions.

The manufacturer or manufacturing apparatus can move the holder member 200 further downward until the gear cogs 234 of the gear shaft 230 engage the thread 434 of the screw space 405. Once the gear cogs 234 have mated with the thread 434, the manufacturer or manufacturing apparatus can rotate the holder member 200 while holding the screw socket member 400, so that the gear cogs 234 may move down along the thread 434. Here, since the connector member 300 is rotatably coupled to the screw socket member 400, the connector member 300 can rotate together with the holder member 200. Although the detent protrusion 414 of the screw socket member 400 rotates above the exposed rims 314, the detent protrusion 414 is formed in a size that does not allow it to touch the bridges 330 and therefore does not obstruct the rotation of the connector member 300.

In certain embodiments of the invention, the upper portion of the screw socket member 400 can be configured to permit a slight degree of elastic deformation. In such applications, the manufacturer or manufacturing apparatus can press the holder member 200 downward even after the gear cogs 234 of the gear shaft 230 have reached the thread 434 of the screw space 405. The upper portion of the screw socket member 400 can be deformed elastically along a particular direction, and the connector member 300 can also be deformed elastically at the same time due to the clearance slits 335, thereby allowing the multiple gear cogs 234 to move over the thread 434 along the vertical direction.

When the holder member 200 is inserted to its designated position in the manner described above, the assembly of the holder member 200, connector member 300, and screw socket member 400 as illustrated in FIG. 8A can be completed.

Next, the manufacturer or manufacturing apparatus can couple the shell member 100 to the connector member 300.

While the coupling protrusion 320 and the guide protrusion 326 are aligned with the coupling hole 120 and the guide slit 126, respectively, the manufacturer or manufacturing apparatus can move the shell member 100 downward from above the connector member 300 to insert the holder member 200 into the shell space 105 of the shell member 100. After most of the holder member 200 and connector member 300 has been inserted in the shell space 105, the guide protrusion 326 may first be inserted into the guide slit 126. Since the bottom of the guide slit 126 is shaped to open wider towards the bottom, the guide protrusion 326 can be readily guided into the guide slit 126. As the guide protrusion 326 is inserted into the guide slit 126, the coupling protrusion 320 can be aligned with the coupling hole 120. Moreover, since the bottom of the clearance slit 122 under the coupling hole 120 is also shaped to open wider towards the bottom, the coupling protrusion 320 can also be guided towards the coupling hole 120.

Although the coupling protrusion 320 protrudes outward, the clearance slit 122 on the one side and the guide slit 126 on the other side of the shell body 110 allow the lower portion of the shell body 110 to undergo an elastic deformation, which causes the shell body 110 to expand and permit the passage of the coupling protrusion 320. Once the shell member 100 is inserted to its designated position, the lower surface of the coupling protrusion 320 may contact the portion under the coupling hole 120. As the coupling hole 120 surrounds the coupling protrusion 320 from all sides, the shell member 100 and the connector member 300 can maintain a securely coupled state. Thus, the shell member 100 can be coupled to the connector member 300 in a manner that does not allow rotation, and the elevating mechanism 1000 illustrated in FIG. 1A to FIG. 2 can be completed. As described above, the elevating mechanism 1000 can also be mounted in a separate lower case (not shown) and overcap (not shown).

Once the shell body 110 surrounds the connector body 310 as above, the connector body 310 may no longer expand, in spite of the clearance slits 335. In this state, there can be no elastic deformation whatsoever in the connector member 300 and the screw socket member 400. It is no longer possible for the gear cogs 234 to move over the thread 434 along the vertical direction, and it is no longer possible for the detent protrusion 414 of the screw socket member 400 to move back into the connector space 315. Thus, the holder member 200, connector member 300, and screw socket member 400 can remain coupled to one another in a very secure state.

The elevating mechanism 1000 for a stick type product and the stick type container having the same according to an embodiment of the invention described above can be assembled in a very simple manner. The screw socket member 400 can be coupled to the connector member 300 by a simple action of inserting the screw socket member 400 into the connector space 315 along a vertical direction; the holder member 200 can be coupled to the connector member 300 by a simple action of inserting the gear shaft 230 through the restricting hole 305 and into the connector space 315 along a vertical direction; and the shell member 100 can be coupled to the connector member 300 by a simple action of inserting the connector member 300 into the shell space 105 along a vertical direction. This makes it possible to assemble small components into a considerably complicated structure in a very simple manner and also enables mass production via an automated process, thereby providing the advantage of reducing the manufacturing costs overall.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. An elevating mechanism for a stick type product, the elevating mechanism comprising:

a holder member having a support part and a gear shaft, the support part configured to support a stick material on an upper portion thereof and be movable along a vertical direction, the gear shaft extending downward from a lower surface of the support part;

a connector member having a connector body, a bridge, and a securing ring, the connector body having a hollow interior to define a connector space therein, the connector space being open at a top and a bottom thereof, the connector body having an upper end exposed at each of a left side and a right side thereof to define an exposed rim, the bridge extending upward from an upper portion of the connector body at each of a front side and a rear side of the connector body, the securing ring defined at an upper portion of the bridge at a position separated from the exposed rim, the securing ring having an annular shape to define a restricting hole therein, the restricting hole configured to receive the gear shaft; and a screw socket member configured to have at least a portion thereof inserted in the connector space, the screw socket member having a hollow interior to define a screw space therein, the screw space being open at a top and a bottom thereof, the screw socket member having an outwardly protruding detent protrusion defined on an upper portion thereof.

2. The elevating mechanism of claim 1, wherein a first clearance slit is defined in an upper portion of the connector body, the first clearance slit extends downward from an upper end of the connector body to a particular depth, and the first clearance slit is defined between a portion where the exposed rim is defined and a portion where the bridge is defined.

3. The elevating mechanism of claim 1, further comprising:

a shell member extending along the vertical direction, the shell member having a hollow interior to define a shell space therein, the shell space being open at a top and a bottom thereof, wherein the support part is configured to move along the vertical direction within the shell space, a coupling hole is defined on one side of the shell member, a coupling protrusion configured to be inserted into the coupling hole is defined on one side of the connector body, an upper portion of the coupling protrusion forms a sloped surface, and a lower portion of the coupling protrusion forms a curb.

4. The elevating mechanism of claim 3, wherein a second clearance slit is defined in the one side of the shell member, and the second clearance slit extends downward from a particular position below the coupling hole to a lower end of the shell member.

5. The elevating mechanism of claim 3, wherein a guide slit is defined in another side of the shell member, and the guide slit extends downward from a particular position to a lower end of the shell member.

6. The elevating mechanism of claim 1, wherein a sloped surface leading to the restricting hole is defined on an inner side of an upper portion of the securing ring.

7. The elevating mechanism of claim 1, wherein a distance between inner surfaces of the bridge located at the front side and the rear side of the connector body is greater than an outer diameter of the detent protrusion.

8. The elevating mechanism of claim 1, wherein a thread is defined at an upper portion of the screw space, and the screw socket member is configured to permit elastic deformation at a portion where the thread is defined.

9. A stick type container comprising the elevating mechanism of claim 1.

* * * * *